US005112108A

United States Patent [19]

Zapf

[11] Patent Number: 5,112,108

[45] Date of Patent: May 12, 1992

[54] SEATING FURNITURE

[76] Inventor: Otto Zapf, Herzog-Adolph-Str. 5, W-6420 Königstein, Fed. Rep. of Germany

[21] Appl. No.: 727,537

[22] Filed: Jul. 9, 1991

[30] Foreign Application Priority Data

Jul. 9, 1990 [DE] Fed. Rep. of Germany 9010340[U]

[51] Int. Cl.[5] ..... A47C 1/024

[52] U.S. Cl. ..... 297/291; 297/306

[58] Field of Search ..... 297/285, 291, 300, 354, 297/306

[56] References Cited

U.S. PATENT DOCUMENTS

| | | | |
|---|---|---|---|
| 293,813 | 2/1884 | St. John | 297/300 X |
| 478,131 | 7/1892 | Richards et al. | 297/354 X |
| 647,178 | 4/1900 | Chechester | 297/284 X |
| 653,105 | 7/1900 | MacLeay | 297/300 X |
| 5,018,791 | 5/1991 | Zapf | 297/460 |

FOREIGN PATENT DOCUMENTS

| | | | |
|---|---|---|---|
| 825147 | 11/1951 | Fed. Rep. of Germany | 297/291 |
| 3826290 | 2/1990 | Fed. Rep. of Germany . | |
| 1301578 | 7/1962 | France . | |

*Primary Examiner*—Peter R. Brown

*Attorney, Agent, or Firm*—Spencer, Frank & Schneider

[57] ABSTRACT

A seating furniture includes a frame having a backrest mounting portion; a seat disposed on the frame; and a backrest disposed adjacent the backrest mounting portion. The backrest includes upper and lower backrest parts extending respectively above and below the backrest mounting portion. The furniture further has a connecting member which attaches the backrest to the backrest mounting portion and which includes a leaf spring secured to the backrest mounting portion and the backrest. The leaf spring positions the backrest in a predetermined angular orientation and resiliently resists an angular displacement of the backrest from the predetermined angular orientation.

3 Claims, 2 Drawing Sheets

SEATING FURNITURE

CROSS REFERENCE TO RELATED APPLICATION

This application claims the priority of German Application No. G 90 10 340.8 filed July 9th, 1990, which is incorporated herein by reference.

BACKGROUND OF THE INVENTION

This invention relates to a seating furniture having a frame, a seat and a backrest which is mounted on the frame approximately at elbow level of a person sitting on the seating furniture. The backrest includes an upper part extending above the mounting of the backrest on the frame as well as a lower part extending below the mounting. The two backrest parts are inclined to each other such that they converge at an obtuse angle in a rearward direction, that is, away from the person seated.

A known seating furniture of the above type is described in German Offenlegungsschrift (published, unexamined application) 38 26 290. In this device the backrest is pivotally mounted at a horizontal frame post. While the inclination of both backrest parts toward each other results in considerably improved sitting comfort as compared with other known seating furniture, it has been found that the pivotal mounting of the backrest at the frame post is not always comfortable. Thus, the backrest does not offer sufficient resistance to the person seated, as the backrest pivots freely around the horizontal axis of the frame post.

In another known seating furniture, disclosed in French Patent 1 301 578, the seat is horizontally slidable. By means of a spring attached to the rear edge of the seat and the frame, the seat is drawn into its rear starting position in which the seat is unoccupied. To the rear edge of the seat a single-piece or a two-part backrest is articulated. Dependent on the position of the seat, the backrest is substantially stretched or also rearwardly arched. The position of the backrest arched to the rear, however, is particularly uncomfortable to a user.

SUMMARY OF THE INVENTION

It is an object of the invention to provide an improved device of the above-outlined type which has improved sitting comfort, even after a user has been sitting for a long time.

This object and others to become apparent as the specification progresses, are accomplished by the invention, according to which, briefly stated, the seating furniture includes a frame having a backrest mounting portion; a seat disposed on the frame; and a backrest disposed adjacent the backrest mounting portion. The backrest includes upper and lower backrest parts extending respectively above and below the backrest mounting portion. The furniture further has a connecting member which attaches the backrest to the backrest mounting portion and which includes a leaf spring secured to the backrest mounting portion and the backrest. The leaf spring positions the backrest in a predetermined angular orientation and resiliently resists an angular displacement of the backrest from the predetermined angular orientation.

While preserving the advantages of the arching of the backrest by providing that the upper and the lower backrest parts are inclined to each other, the backrest according to the invention does not pivot freely about the frame, but is attached thereto by a leaf spring, thereby having the effect that the lower and upper backrest parts are mounted resiliently to the frame. The spring force is exerted through the backrest to the back of the user and affords a resistance perceived to be pleasant, while the inclination of both backrest parts relative to each other is always maintained.

As compared with other types of springs, a leaf spring offers the advantage that there are no problems when positioning the spring. The flat extension of the leaf spring by which the spring force is effected, conforms to the flat backrest. Moreover, the required spring force can be advantageously exerted by a leaf spring. Therefore, the seating furniture according to the invention is distinguished by an extraordinary design, particularly because the spring force is effected by the flat spring extension which directly engages the lower backrest part, and which may even serve as the actual lower backrest part.

The flat spring extension, as seen from the rear side of the seating furniture, is either visible or may be hidden by a cover.

DESCRIPTION OF THE PREFERRED EMBODIMENT

Figure 1:
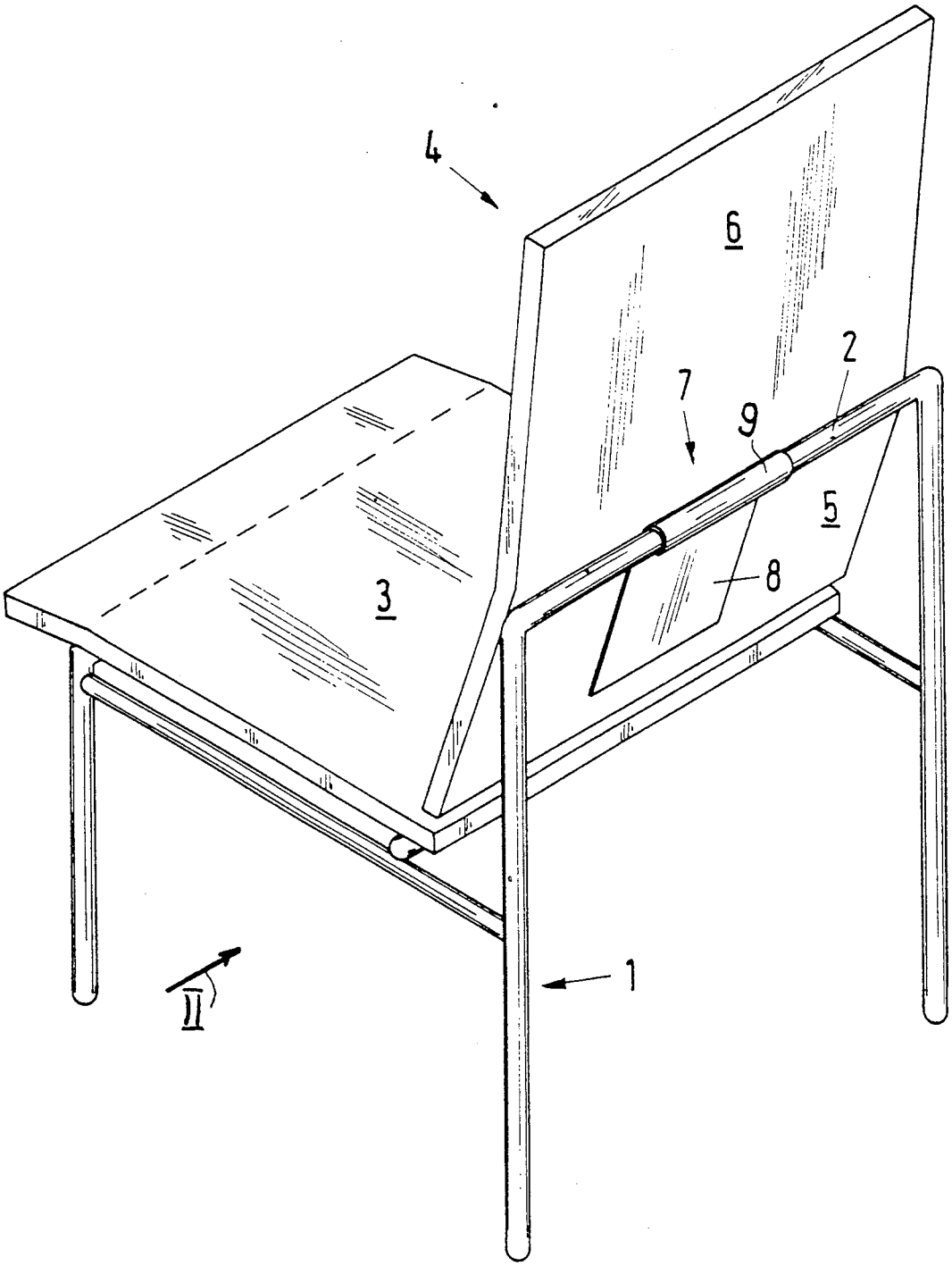
FIG. 1 is a perspective view of a preferred embodiment of the invention as viewed from above and behind.
Figure 2:
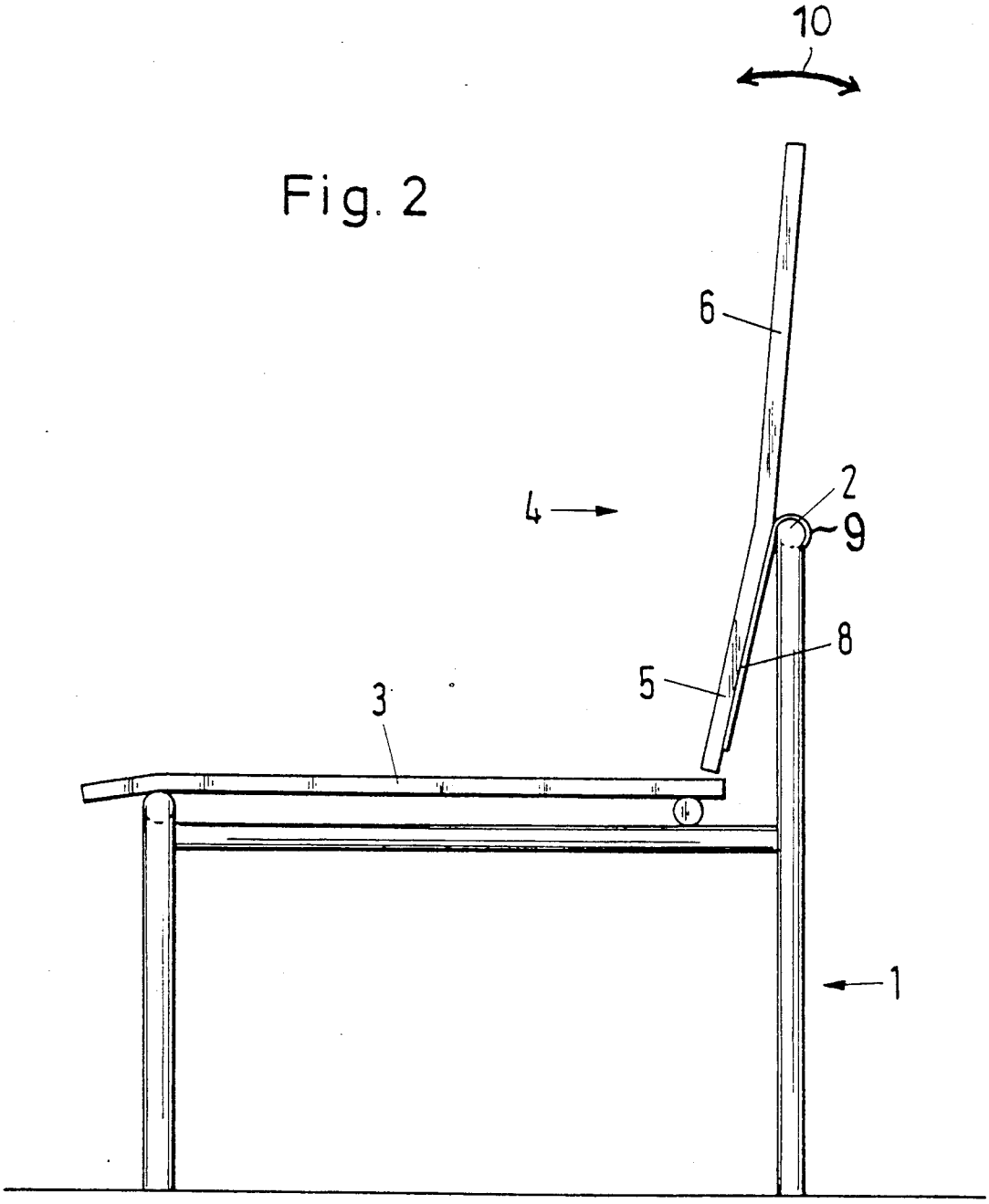
FIG. 2 is a side elevational view of the preferred embodiment as viewed in the direction of arrow II in FIG. 1.

Turning to FIG. 1, the seating furniture, depicted as a chair shown therein has a frame 1 which includes a transversely extending frame member or backrest mounting portion 2. The seating furniture includes a substantially horizontal seat 3 and a generally vertically extending backrest 4.

Approximately at the level of transverse frame member 2, that is, at the level of the elbows of a user of average build sitting on seat 3 of the seating furniture, at which level arm rests may be provided, backrest 4 is bent, so that approximately starting from the level of the transverse frame member 2, a lower backrest part 5 and an upper backrest part 6 are defined. Both backrest parts are inclined toward each other such that they converge at an obtuse angle in a rearward direction.

A leaf spring 7 is mounted at transverse frame member 2 and has a wide, flat, extension or main body portion 8 which is attached to lower backrest part 5 in a face-to-face engagement therewith. Leaf spring 7 is affixed to transverse frame member 2 by a curved connecting portion 9. A resilient deformability between the extension 8 and the connecting portion 9 allows a spring-biased swinging motion of backrest 4 in the directions indicated by a double-headed arrow 10.

In use, the upper backrest part 6, which is bent forwardly, engages the back of a person sitting on the seat of the seating furniture, while the lower backrest part is resiliently biased by leaf spring 7. As both backrest parts, which may be rigid or flexible, are connected to each other, the upper backrest part 6 is also resiliently biased.

According to the invention seating furniture of all kinds can be constructed, that is, not only chairs but also armchairs, and the like. The leaf spring 7, or its flat extension 8 may be provided with a suitable cover for making it invisible. The backrest and/or the seat may be upholstered.

It will be understood that the above description of the present invention is susceptible to various modifications, changes, and adaptations, and the same are intended to be comprehended within the meaning and range of equivalents of the appended claims.

What is claimed is:

1. In a seating furniture including a frame having a backrest mounting portion;

a seat disposed on said frame;

a backrest disposed adjacent said backrest mounting portion; said backrest including upper and lower backrest parts extending respectively above and below said backrest mounting portion; and connecting means for attaching said backrest to said backrest mounting portion;

the improvement wherein said connecting means comprises a leaf spring secured to said backrest mounting portion and said backrest; said leaf spring positioning said backrest in a predetermined angular orientation and resiliently resisting an angular displacement of said backrest from said predetermined angular orientation; said leaf spring being formed of a curved connecting portion attached to said backrest mounting portion and a flat, planar main body portion lying substantially in its entirety on said lower backrest part in a face-to-face engagement therewith.

2. A seating furniture as defined in claim 1, wherein said backrest mounting portion is disposed approximately at a level corresponding to the level of an elbow of a user of average build sitting on said seat.

3. A seating furniture as defined in claim 1, wherein said upper and lower backrest parts are inclined toward each other.

* * * * *